United States Patent [19]

Burrage et al.

[11] Patent Number: 4,598,265

[45] Date of Patent: Jul. 1, 1986

[54] CAPACITOR FUSE LEADER FLIPPER

[75] Inventors: Lawrence M. Burrage, So. Milwaukee; J. Howard Shaw, Racine, both of Wis.; James R. Marek, Olean, N.Y.; David W. Anderson, Greenwood, S.C.

[73] Assignee: Cooper Industries, Inc., Houston, Tex.

[21] Appl. No.: 648,033

[22] Filed: Sep. 6, 1984

[51] Int. Cl.[4] ..... H01H 71/20; H01H 73/22

[52] U.S. Cl. ..... 337/219; 267/73; 337/178

[58] Field of Search ..... 337/217, 218, 219, 220, 337/178, 195, 203, 214; 267/159, 158, 73; 248/51, 52, 302

[56] References Cited

U.S. PATENT DOCUMENTS

| | | | |
|---|---|---|---|
| 2,133,139 | 10/1938 | Hermann | 337/219 |
| 2,296,991 | 9/1942 | Fox | 337/217 |
| 4,121,186 | 10/1978 | Santilli | 337/219 |

*Primary Examiner*—Harold Broome

*Attorney, Agent, or Firm*—Nelson A. Blish; Eddie E. Scott; Alan R. Thiele

[57] ABSTRACT

A flipper is described for a fuse of the type having a generally cylindrical fuse tube, a fusible element within the tube and a fuse leader, the fuse leader having two ends with one of the ends connected to the fusible element disposed within the tube and with the other end of the leader adapted to be connected to a fixed terminal such as one of the two terminals of a power factor capacitor. In one embodiment, the flipper has two elongated arms disposed adjacent one another, a helical torsion spring at one end of each arm, an eyelet connecting together the other end of the arms and adapted to pass through the fuse leader, and a hook or similar connection carried by the springs to mount the flipper assembly to the associated terminal to which the free end of the fuse leader is joined. The flipper assists in the extraction of the leader from the fuse tube and provides positive restraint of the leader after the fuse has blown. Several specific embodiments are described wherein the lateral displacement of the torsion springs is controlled, the lateral displacement of the leader arms is varied, and the angular relationship between the flipper arms and the terminal connection is changed.

29 Claims, 13 Drawing Figures

12
12a
12b
14a
14b
16a
16b
18
20
22
24
26
28
30
32
34a
34b
36a
36b
38
40
42

FIG. 5B
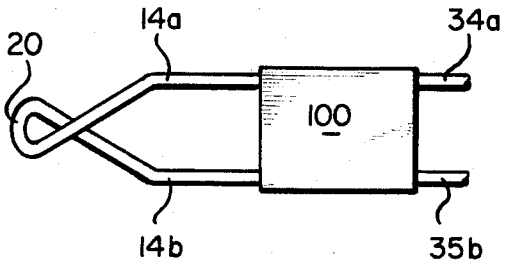
FIG. 3
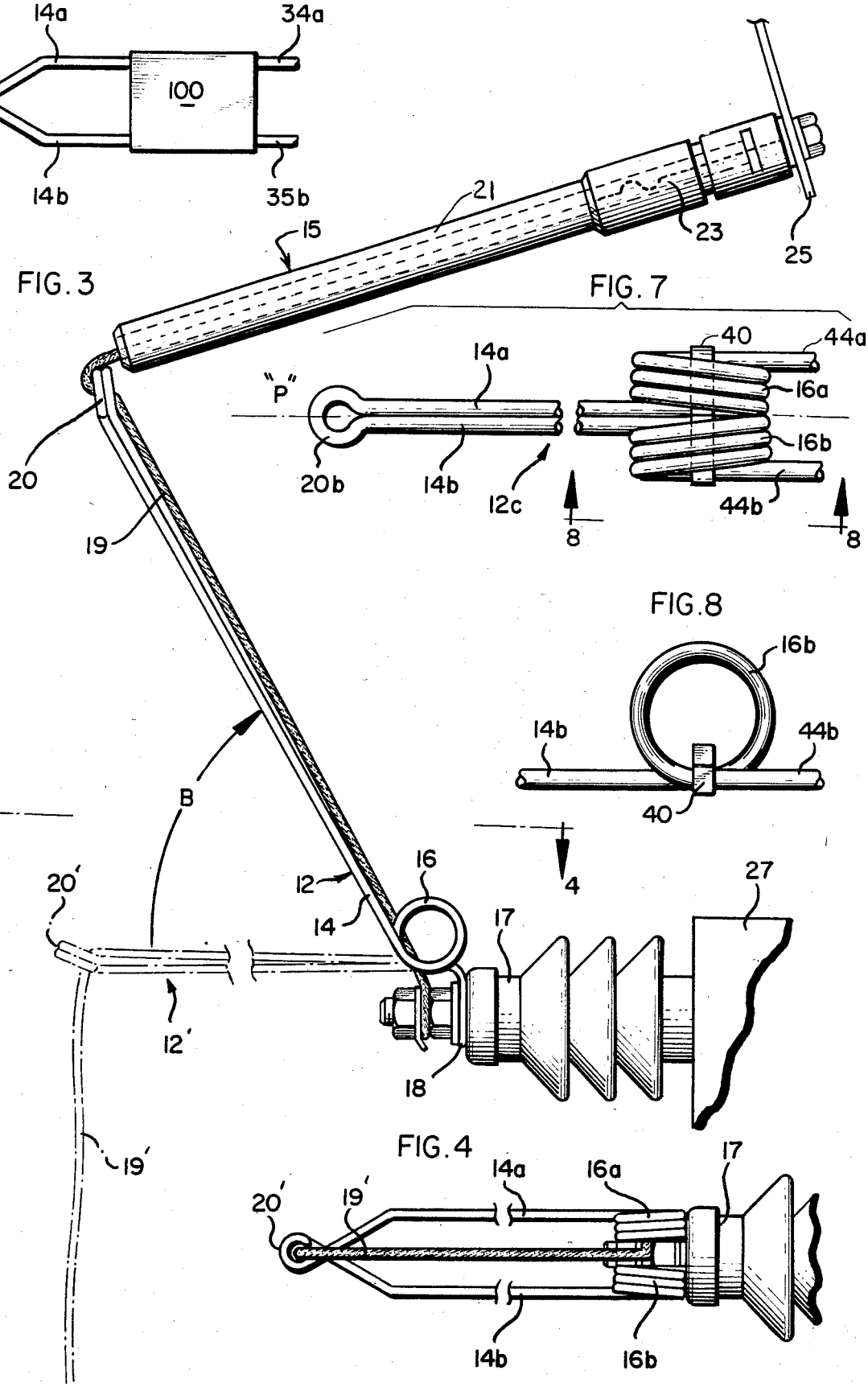
FIG. 7
FIG. 8
FIG. 4

CAPACITOR FUSE LEADER FLIPPER

TECHNICAL FIELD

This invention relates to the general subject of fuses, and in particular, to indicating-type expulsion fuses which are used to protect capacitors.

BACKGROUND OF THE INVENTION

Capacitors have proven to be an effective low cost means for controlling power factor in electrical distribution and transmission systems. The problem at hand is to provide the best possible capacitor protection, to optimize capacitor usage, and to minimize or eliminate circuit outages associated with capacitor installations. In essence, this means providing coordinated protection to maximize capacitor utilization and to minimize the effects of capacitor failure or rupture.

When a power-factor correction capacitor fails, it is essential that the unit be disconnected from the associated electrical network. If the failing capacitor is not disconnected within a relatively short time, the capacitor tank may rupture. Capacitor tank failure can result in the discharge to the environment of hazardous materials, such as polychlorinated biphenyl's (PCB's). Tank rupture prevention is also important since a tank rupture can result in a fire. This is because some capacitors contain a combustible dielectric fluid.

Substation capacitor banks are normally equipped with individual capacitor unit fuses. To operate successfully, a capacitor fuse must interrupt the capacitor unit circuit after the capacitor fails, but before the capacitor tank ruptures. This requirement of tank rupture prevention is of particular importance because of the environmental and safety issues often associated with the materials used in capacitors.

In certain applications capacitors can be safely fused with indicating-type expulsion fuses. Individual expulsion fuses for capacitor banks are less costly than current limiting fuse installations. An example of an early expulsion fuse is presented in U.S. Pat. No. 2,096,983. These fuses are preferably bus-mounted, indicating-type expulsion fuses. Examples of such fuses are shown in U.S. Pat. Nos. 4,121,186 and 4,275,373.

Power-factor capacitors are normally installed in a horizontal array or bank. They are either pole-mounted, mounted upright or along their sides in a single row (e.g., FIG. 1 of U.S. Pat. No. 4,121,186) or multitiered array, or in an outdoor metal enclosure. In each case the individual capacitor units are ganged together leaving sufficient space for natural-air circulation and cooling. When the capacitor units are closely spaced to each other, the use of individual bus-mounted, indicating-type expulsion fuses can become a source of difficulty. Those skilled in the art know that an indicating-type expulsion fuse link includes: a flexible lead or "fuse leader" (sometimes called a "pig-tail"), a fusible element, a ferrule or "button", and a tubular enclosure. The fuse leader is connected to one end of the fusible element. The other end of the element is connected to the ferrule which is carried by the fuse housing. The fusible element, a portion of the ferrule and the fuse leader are contained within the tubular enclosure (sometimes referred to as the "auxiliary tube"). This fuse link is then assembled within a hollow insulated tube (sometimes called the "fuse tube"). When fault current is initiated, the temperature of the fusible element rapidly increases and melts. The current flowing through the fuse then bridges a tiny gap and an arc is formed. The arc grows and expands rapidly. The arc heats the internal surface of the auxiliary tube causing it to decompose and produce gas. The turbulent high pressure gas thus developed tries to break-up the arc. As the arc and gas resist each other, an equilibrium arc position is established. The pressure in the tube builds up rapidly and the gas begins to vent from the bottom of the fuse tube. During this same time the arc length increases as the gas blows the fuse leader out of both tubes. As current zero approaches, the diameter of the arc diminishes and eventually disappears. However, the fuse leader is expelled from the fuse tube at high velocity. Under some conditions, the free end of the fuse leader has been known to be thrown against the adjacent leaders connected to the capacitors on either side of a capacitor unit that suffered an over-current condition. This can cause a cascading effect resulting in multiple fuse blowings and can contribute to early failure of the associated capacitors.

It is relatively common practice to provide a spring-like device connected to the exposed end of the fuse leader when an indicating-type expulsion fuse is used. (See U.S. Pat. No. 4,275,373) This device facilitates the removal of the fuse leader from the fuse tube when the fuse operates. The spring also tends to bias or hold the exposed end of the flexible fuse leader away from the adjacent capacitor units. These spring-like devices are in some cases simple coil springs; in other cases they are essentially flat pieces of metal or leaf springs, the plane of which is oriented generally perpendicular to the longitudinal axis of the insulated tube at the end of the expulsion fuse. However, in most cases these spring-like devices are relatively flimsy and do little to control the whipping of the fuse leader following expulsion. One solution to this problem is described in Soviet Union Invention Certificate SU 936-070 which was published on June 15, 1982. That certificate describes a "link catcher". The link catcher is made from a flat ring with its center disposed along the axis of the fuse tube. The ring, as such, catches the free end of the fuse leader and prevents tangling of contacts or the striking of adjacent members. This prevents adjacent fuses from actuating and multiple capacitors from being taken out of service. This device, however, is very dependent upon the alignment between the end of the fuse tube and the center of the link catcher. Another approach to the problem is described in U.S. Pat. No. 3,783,342. There an integral cage is used to control the release of debris when the fuse actuates. Neither invention can be said to be a positive or active means for leader whip control.

Considering the importance of capacitor banks and the eventual consequences of several fuses blowing in the same bank, a reliable design is needed for a device to minimize the effects of leader whip following the operation of an expulsion fuse. Such a design will go far to improve capacitor reliability, the protection of the environment and the efficient use of electricity.

SUMMARY OF THE INVENTION

In accordace with the present invention a flipper for a fuse having a leader is disclosed which minimizes the effect of expulsion fuse leader whip, particularly when such a fuse is bus-mounted for protection of a horizontal array or bank of power factor correction capacitors. In particular, the flipper comprises two elongated arms which are disposed adjacent one another, spring means at one end of at least one arm for biasing the other end of that arm away from the fuse, hook means for joining the spring means to the terminal to which the fuse leader is connected, and connection means at the other end of the arms for receiving the fuse leader intermediate the ends of the leader, whereby, in the event that the leader is released by the fuse, the free end of the leader is flung away from the fuse and is held at a spaced distance from the leader terminal. In one embodiment, the spring means comprises two torsion springs, each of which is integrally connected to one of the flipper arms and the hook means. In another embodiment the arms are formed from a stainless steel wire, each arm crossing over the other and having a generally Z-shaped configuration such that the ends of the arms are parallel to and spaced apart from each other and in the same plane. The Z-shaped configuration resists the tendency of the arms to be displaced laterally in their common plane. The resistance against lateral displacement is enhanced by the inclusion of a clip which ties together both arms where the Z-shaped portions cross over each other. In one embodiment the spring means is in the form of a helical torsion spring; lateral stability is improved by adding at least one clip which ties together the coils of the helical spring. In one embodiment the hook means is formed from a generally U-shaped section of wire which is adapted to fit the terminal to which the leader is connected. In one embodiment the connection means is formed from a section of wire integrally connected to the two arms so as to define an eyelet. Preferably this eyelet is coated with an epoxy material to electrically insulate the connection means from the fuse leader. The epoxy insulation prevents current from flowing through the fuse leader to the arms of the flipper thereby preventing a tempering effect on the mechanical properties of the arms, as well as preventing the leader from welding to the eyelet during fuse operation. Welding could prevent or impede spring action. In still another embodiment the helical torsion springs are spaced apart from each other and at a sufficient distance from the leader terminal that they literally capture the fuse leader when it is blown from its fuse tube. Combinations of these various features are also disclosed.

Thus, a unique capacitor fuse leader flipper is provided which features reduced lateral motion of the blown fuse leader and added restraint to those longer leaders often associated with high voltage capacitor fuses. Such a flipper allows the designer of a bank of high voltage capacitors to provide smaller separation between adjacent capacitor tanks and expulsion fuse units. Thus, one can obtain a greater capacitive reactance in a given space. This results in savings in real estate and allows one to take the maximum advantage of the available space. More importantly, the likelihood of the failure of one capacitor unit and its blown fuse causing an adjacent fuse blowing on adjacent capacitor units is reduced, thereby improving the overall reliability of the installation. These and other advantages and features of the present invention will become readily apparent from the following detailed description of the invention, the many embodiments illustrated in the drawings, and from the claims wherein the novel and unique combination of elements forming the invention will be found to produce a highly beneficial and somewhat surprising improvement over the prior art.

DESCRIPTION OF THE DRAWINGS

FIG. 3 is a side view of another flipper illustrating the relative position of the flipper before and after actuation;

FIG. 4 is a plan view of the flipper shown in FIG. 3 taken along line 4—4 following actuation of fuse;

FIG. 5B illustrates another method of increasing the lateral stability of the flipper arms;

FIG. 7 is a partial plan view of yet another embodiment of the invention;

FIG. 8 is a partial side elevational view of the flipper shown in FIG. 7 taken along line 8—8;

DETAILED DESCRIPTION

Figures 1, 1A, 2, 5A, 6:
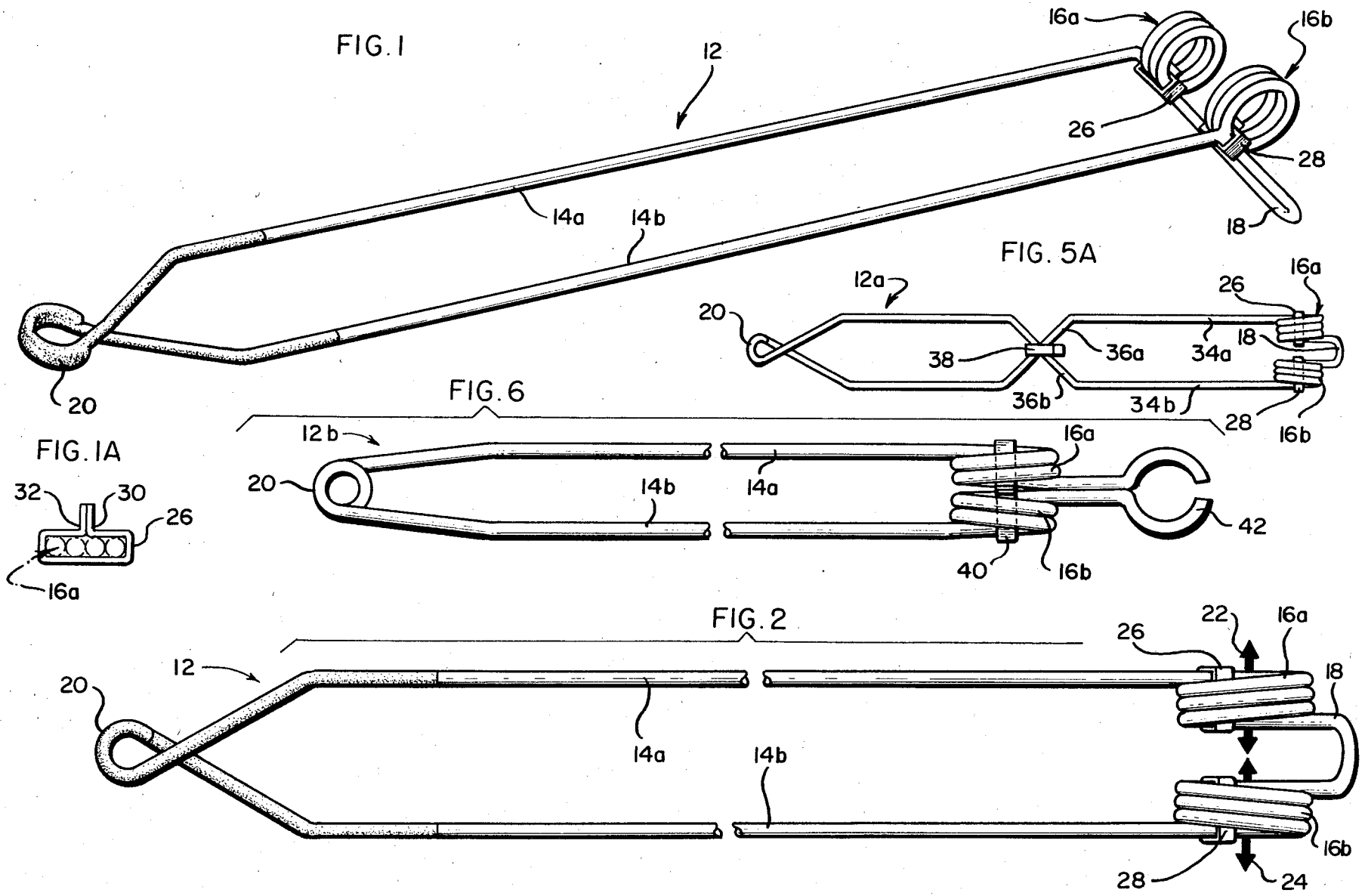
FIG. 1 is a perspective view of one embodiment of the fuse-leader flipper that is the subject of the present invention.
FIG. 1A is a front view of one of the clips or spring retainers shown in FIG. 1.
FIG. 2 is a plan view of the flipper shown in FIG. 1.
FIG. 5A is a plan view of another embodiment of the invention showing one means of increasing the lateral stability of the flipper.
FIG. 6 is a plan view of still another embodiment of the invention.

While this invention is susceptible of embodiment in many different forms, there are shown in the drawings and will herein be described in detail several embodiments of the invention each of which, depending upon the circumstances and the environment of the installation, may be a preferred embodiment of the invention. It should be understood that the present disclosure is to be considered an exemplification of the principles of the invention and it is not intended to limit the invention to any specific embodiment illustrated. The scope of the invention will be pointed out in the appended claims.

For the purpose of better understanding the invention and the manner in which it interfaces with its operating environment, we will first turn our attention to FIG. 3. FIG. 3 illustrates a bus-mounted, indicating-type, expulsion, capacitor fuse 15, a side-mounted or edge-mounted capacitor 27, a capacitor bushing or terminal post 17 and one embodiment of the flipper 12 that is the subject of the present invention. Those skilled in the art know that so called indicating type expulsion fuses are provided with a generally flexible, electrically conductive fuse leader 19. One end of the fuse leader is free and is adapted to be connected to a terminal of the electrical component to be protected by the fuse. The other end of the leader 19 is disposed within the interior of a hollow fuse tube 21 and connected to a fixed fuse element 23 (illustrated schematically in FIG. 3). This fuse element 23 is in turn connected to a bus-bar 25. Thus, the fuse leader 19 provides a flexible connecting means between the fixed fuse element 23 and the capacitor terminal 17. If one simply looks at the flipper 12 as a spring having one end 20 (see FIG. 11) which is normally biased away from the fuse 15, then the flipper can be considered as a means for applying a force to extract or eject the leader 19 out of the fuse tube 21. Thus, when the fusible element 23 melts and arcing occurs, the fuse leader 19 will be ejected from the tube 21, not only because of the pressure of the gases developed within the fuse tube, but also because of the action of the flipper 12.

Now that an overview of the basic function of the flipper 12 has been given let us turn to the first embodiment of the invention. The flipper 12 in FIG. 1 is formed from 18-8 corrosion resistant spring quality stainless steel. In one specific embodiment which has been tested in the field, wire having a diameter of 0.102 inches was found to perform satisfactorily. The flipper 12 has four major parts: a pair of elongated arms 14*a* and 14*b*, a set of helical coil torsion springs 16*a* and 16*b*, at one end of each arm, a hook section 18 for anchoring or connecting the flipper to the associated capacitor terminal or bushing (See FIG. 3 and FIG. 11), and a looped connection 20 at the other end of the arms for receiving therein the fuse leader 19. It should be understood from the drawings that the flipper 12 can be readily formed from one continuous length of wire. The ends of the wire terminate within or at the leader connection 20 by wrapping the ends in the form of an eyelet. It should also be appreciated that the number of helical turns in each spring 16*a* and 16*b*, the cross section of the wire used to form the flipper 12, the material properties of the wire, and the overall length of the flipper, all combine to determine the tension or force applied to the fuse leader 19 when the flipper is installed (See FIGS. 3 and 11).

Those also skilled in the art know that depending upon the length of the arms 14*a* and 14*b* and the relative position of the terminal 17 to the fuse 15, the arms will bend or deflect when the flipper is installed. This is most clearly illustrated in FIG. 11. It is important that the yield strength of the spring material not be exceeded. If that were to occur, the flipper would take a permanent "set" and therefore not provide optimum performance.

The eyelet 20 at the free end of flipper 12 is coated with an insulating material, preferably an epoxy such as HYSOL NB 2336-90. The epoxy insulation prevents electrical contact between the eyelet 20 of the flipper 12 and the fuse leader 19. Since the leader 19 normally has current flowing through it, there is a tendency for a "tempering effect" to be produced on the mechanical properties of the flipper in the absence of the insulation. This tempering effect can, in the long term, reduce the tensile load on the fuse link and prevent optimum performance of the flipper. The use of the insulating material also prevents the welding of the fuse leader 19 to the eyelet 20. If the welding were to occur, relative motion between the flipper eyelet and the leader would be prevented, eliminating the function of the springs 16*a* and 16*b* (See FIGS. 9, 10 and 11).

In addition to the bending of the arms 14*a* and 14*b* of the flipper 12 when the flipper is installed about the fuse leader 19 (See element 14 on FIG. 11), it has been observed that there is a tendency for a flipper to move laterally in the plane defined by the two flipper arms when the expulsion fuse 15 is actuated. In other words, because of the tension in the flipper 12 brought about by the twisting of the torsion spring 16*a* and 16*b*, the release of this tension results in the helical coils spreading apart (See arrows 22 and 24 in FIG. 2). This effectively allows the arms 14*a* and 14*b* to laterally spread apart from each other, since the hooked or terminal end 18 of the flipper 12 is effectively fixed in place on the terminal 17. To prevent this lateral displacement and to otherwise confine or limit the lateral displacement of the flipper arms 14*a* and 14*b*, a set of stainless steel clips 26 and 28 are wrapped about each torsion spring 16*a* and 16*b*. Preferably these clips or spring retainers are made from a 301 or 302 annealed stainless steel. FIG. 1A represents a cross-section of the clip or retainer. In this embodiment the clip 26 is formed from flat steel ribbon which is bent into a generally rectangular structure with two tab-like ends 30 and 32 welded together. Other structures may be used to perform this same function.

There are other techniques which may be used to improve the lateral stability of the arms of the flipper 12. For one, the overall length of the arms 14*a* and 14*b* should be kept as short as possible. FIG. 5A illustrates a particularly advantageous flipper design 12*a*. In that design the flipper arms 34*a* and 34*b* have a generally Z-shape configuration. Each Z-shaped arm has an intermediate leg 36*a* and 36*b* which crosses over the other in essentially the same plane so as to form an "X". The effect of this cross-over is to reduce the length of the free span between the springs 16*a* and 16*b* and the leader eyelet 20. A further improvement of lateral stability can be obtained by clipping together the two intermediate legs 36*a* and 36*b* with a clip 38 similar to that used for the spring retainers 26 and 28. The eyelet 20 is again covered with an insulating material. Satisfactory performance has been obtained with this embodiment when the distance between the flipper eyelet 20 and the torsion springs is between 6 and 14 inches, with a span of 6 to 10 inches being preferred. FIG. 5B illustrates a portion of a flipper wherein a generally rigid flat metal strip 100 is used to increase lateral stability.

Lateral stability of the flipper arms can also be improved by reducing the lateral separation between the torsion springs 16*a* and 16*b* and the arms 14*a* and 14*b*. Such an embodiment is illustrated in FIG. 6. In FIG. 6 a single spring retaining clip 40 is used for the flipper 12*b*. In addition the terminal hook 42 takes on a C-shaped-configuration. Still another application of this principle is illustrated in FIGS. 7 and 8. In FIG. 7 the two arms 14*a* and 14*b* of the flipper 12*c* are placed immediately adjacent one another and the coils of the torsion springs are wound inboard to outboard relative to the plane of symmetry "P". Just as in FIG. 6, a single spring retaining clip 40 is used. The terminal hook (i.e., at the end of arms 44*a* and 44*b* to the right of the springs 16*a* and 16*b*) is not shown; it can take on the configuration shown in FIG. 1. The flipper eyelet 20*b* resembles the shape of an ordinary cotter pin. The eyelet 20*b* is also covered with an insulating coating.

Figure 9:
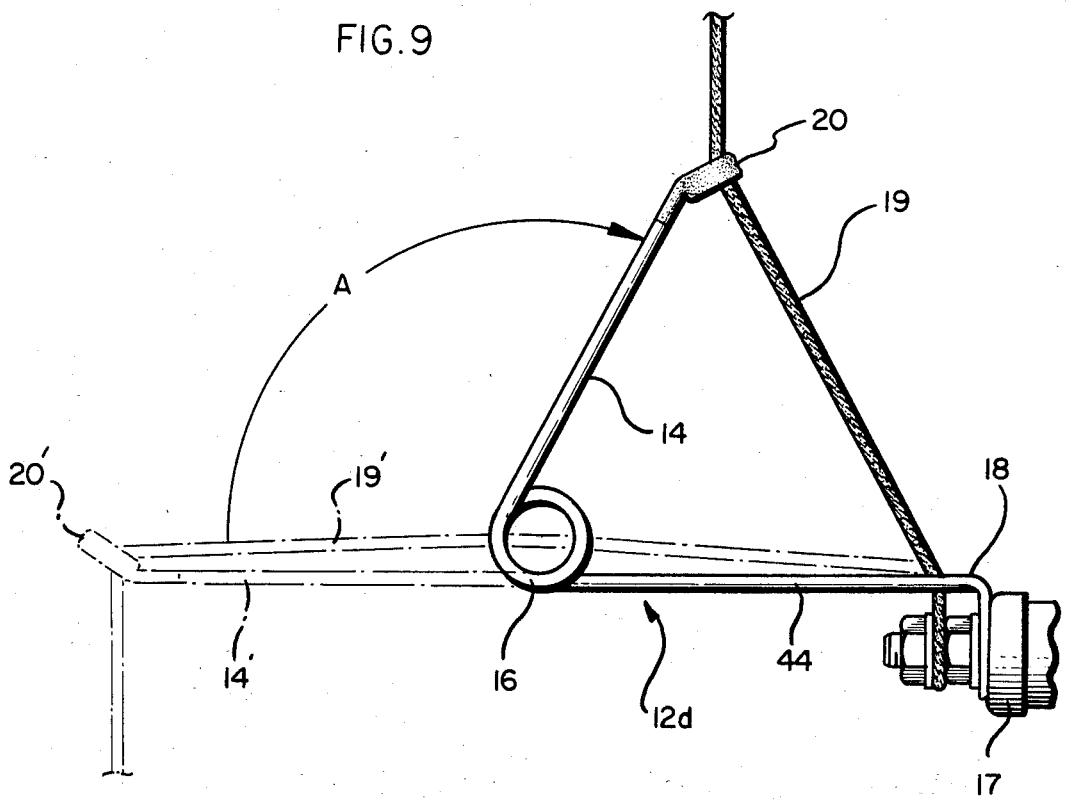
FIG. 9 is a side elevational view of still another embodiment of the invention illustrating the position of the flipper before and after actuation.
Figure 10:
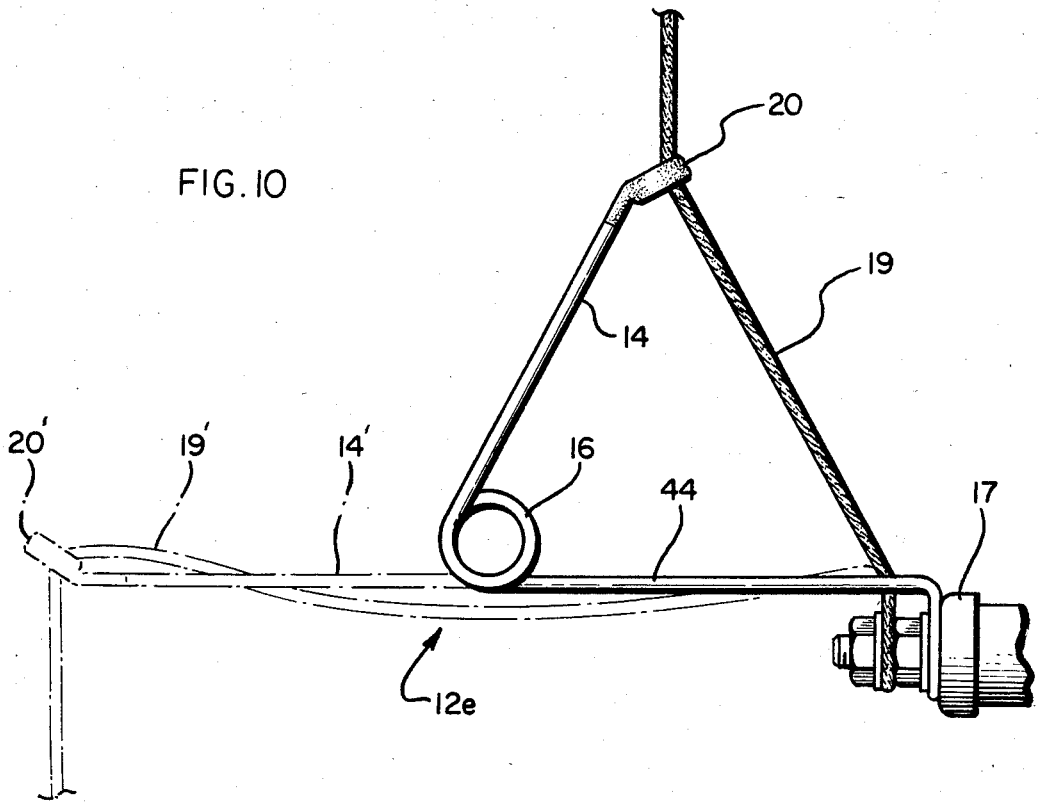
FIG. 10 is a side elevational view of a flipper, somewhat similar to that shown in FIG. 1, showing the relative position of the flipper and the fuse leader before and after the actuation of the fuse.

Another technique which may be used to minimize the effects of leader whip following actuation of the associated expulsion fuse, is to hold the free end of the expended leader as far as possible from the leaders and flippers of adjacent capacitors. Turning to FIG. 9, a flipper 12*d* is illustrated which has an extended set of arms 44 between the terminal hook 18 and torsion spring 16. Thus, when the flipper 12*d* is installed, the arms 14 between each torsion spring 16 and the eyelet 20 are bent through a greater angle "A" than the flipper 12 first described (See angle "B" in FIG. 3). Preferably the two halves of the torsion spring 16 are disposed relatively close to each other, such as that shown in FIG. 6 or FIG. 7. If this is done, the expended leader 19' will be suspended by the spring 16. If the two halves of the spring 16 are spaced relatively far apart from one another (e.g., FIG. 1), the expended leader 19' will sag or droop below the plane defined by the two arms 14' and 44' to either side of the spring 16 (See FIG. 10). Thus, by properly selecting lateral spacing between the two halves of the spring 16 it is possible for the expended leader 19' to be "captured" by the spring. This will further prevent any tendency for the expended leader 19' to "whip" after the fuse 15 is actuated.

Figure 11:
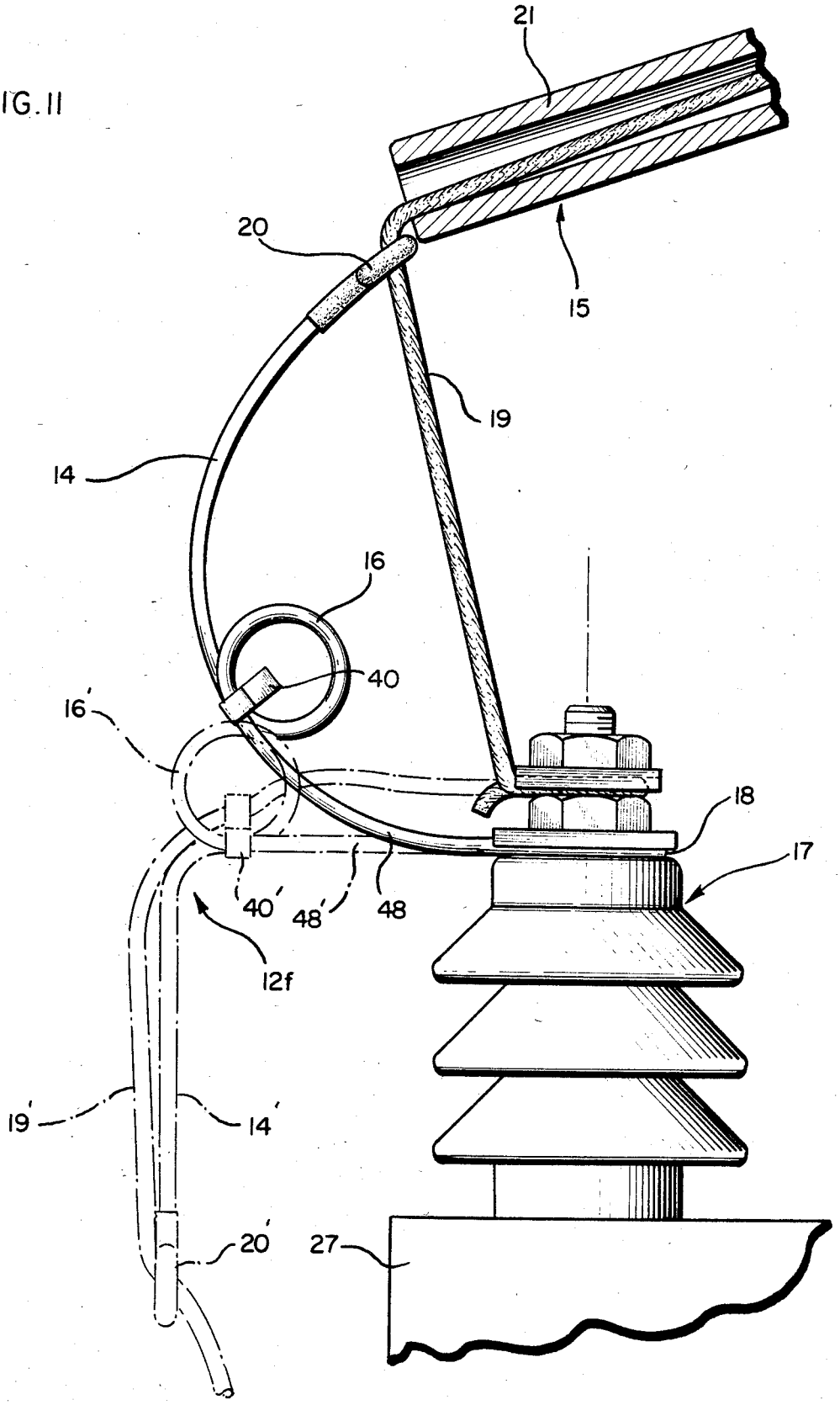
FIG. 11 is yet another embodiment of the invention showing the relative position of the flipper before and after fuse actuation.

FIG. 11 illustrates an embodiment which is particularly useful in those installations where space is at a premium. In FIG. 11, the axis of the capacitor terminal 17 is generally vertical. In FIG. 3 the axis of the capacitor terminal 17 was generally horizontal. In FIG. 11 the arms 48 between the torsion spring 16 and the capacitor terminal 17 are disposed generally at right angles to the arms 14 between the eyelet 20 and the torsion spring before the fuse leader is installed. In FIG. 9 the arms 44 and 14' on either side of the spring 16, generally lie in the same plane before the leader 19 is installed. It should be understood, of course that the flippers shown in FIG'S. 9, 10 and 11 are double armed flippers. Thus, in the embodiment shown in FIG. 11 in the process of installing the leader 19 through the flipper eyelet 20 and connecting the leader to the capacitor terminal 17, the arms 14 joined to the eyelet 20 must be bent through an angle in excess of 180°. This design not only keeps the free end of the released fuse leader far away from adjacent fuse leaders but also minimizes any whipping effect. The whipping effect is particularly reduced when the two halves of the spring 16 are spaced in such a manner as to capture the expended leader.

It should be appreciated from the foregoing that the various embodiments of the expulsion-fuse leader flipper will provide for improved capacitor bank performance, in that they reduce the likelihood of one capacitor failure cascading and causing other fuses to blow or other capacitors to be damaged due to the whipping of the leader. It should be obvious to those skilled in the are in view of the foregoing description that there are many other variations which can be developed from the embodiments specifically described. For example, the leader eyelet may take on any number of configurations in combination with any means to connect the flipper to the capacitor terminals. Similarly, although simple helical torsion springs were illustrated, other devices having the same effect may be used. All such variations are within the spirit and scope of the present invention; consequently, the foregoing discussion is not meant to limit the invention as claimed, but only to lead to a better understanding of the operation of the various elements which form the invention.

We claim:

1. In a fuse of the type having a generally cylindrical fuse tube a fusible element carried within the tube and a fuse leader, said leader having two ends with one of the ends of the leader connected to the fusible element and with the other end adapted to be connected to a fixed terminal located at a spaced distance from the fuse, a flipper comprising:

a. two elongated arms disposed adjacent one another, each of said arms having two ends which are oppositely disposed, said arms defining a plane which is disposed at an angle to the axis of the fuse tube;

b. spring means, at one end of each of said arms, for biasing the other end of each arm away from the fuse;

c. hook means, carried by said spring means, for joining said spring means to the terminal to which said fuse leader is connected; and d. connection means at the other end of said arms, for receiving said fuse leader intermediate the ends of the leader, said arms having a sufficient length such that, when said leader is passed through said connection means and connected to the terminal, said spring means is overcome, whereby in the event that the leader is released by the fuse, the free end of the leader is flung away from the fuse and is held at a spaced distance from the terminal.

2. The flipper set forth in claim 1, wherein the fuse is an indicating-type expulsion fuse.

3. The flipper set forth in claim 1, wherein the fuse is generally disposed in a first vertical plane; and wherein the terminal is connected to one of the two electrical connections on a power factor capacitor, said two electrical connections defining a second vertical plane which is generally parallel to said first vertical plane.

4. The flipper set forth in claim 1, wherein said spring means comprises a torsion spring defining two end, one of which is integrally connected to said one end of one of said arms.

5. The flipper set forth in claim 1, wherein said arms are parallel to one another over a substantial portion of their length so as to define a plane which, when the leader is free from said fuse, is at an acute angle to the axis of the fuse tube.

6. The flipper set forth in claim 1, wherein said arms are parallel to and spaced apart from each other at a fixed distance over a substantial portion of their length, and wherein said one end of each of said arms is parallel to and spaced apart from its opposite end.

7. The flipper set forth in claim 1, wherein each of said arms lies generally in the same plane and is bent at two points intermediate its ends so that one end of each arm is disposed parallel to and at a spaced distance from its other end and the corresponding end of the other arm.

8. The flipper set forth in claim 7, wherein each arm is Z-shaped and wherein each arm is generally in the same plane.

9. The flipper set forth in claim 1, wherein the ends of each of said arms are parallel to one another and wherein each arm has an intermediate portion which crosses over the corresponding intermediate portion of the other arm so as to assume a generally X-shaped configuration intermediate said connection means and said spring means.

10. The flipper set forth in claim 1, further including: clip means, carried by said arms, for limiting the lateral displacement of said arms intermediate their ends.

11. The flipper set forth in claim 1, wherein said spring means comprises a helical coil spring defining two ends, one of which is connected to said one end of one arm.

12. The flipper set forth in claim 1, whrein each of said elongated arms is formed from a generally rigid section of wire and wherein said spring means comprises a coiled section of wire formed into a helical torsion spring and integrally connected to one of said arms.

13. The flipper set forth in claim 12, wherein said coiled section of wire comprises a plurality of turns.

14. The flipper set forth in claim 12, wherein a coiled section of wire formed into a helical torsion spring is connected to each arm, and wherein each spring consists of a plurality of turns.

15. The flipper set forth in claim 14, wherein said turns of wire are wrapped one about each other with each turn being immediately adjacent the previous turn.

16. The flipper set forth in claim 14, wherein said coils of wire are formed by wrapping said wire in the form of a closely spaced helix defining two ends with one end integrally joined to one arm at said one end of said one arm, said one end of said helix being disposed at a greater distance from said one end of the other arm than the other end of said helix.

17. The flipper set forth in claim 16, further including clip means, carried by said helix, for limiting lateral displacement of the ends of said helix.

18. The flipper set forth in claim 11, wherein said hook means is formed from a generally U-shaped section of wire defining a bite portion and two uprights, said bite portion being adapted to fit the terminal and said uprights being joined to the other end of said spring.

19. The flipper set forth in claim 1, wherein said hook means is formed from two sections of wire, each section of wire comprising:

a generally C-shaped section adapted to fit the terminal and;

an elongated section defining two ends, with one end joined to said C-shaped section at one end, and with the other end joined to said spring means.

20. The flipper set forth in claim 19, wherein each elongated section is parallel to the other elongated section and is immediately adjacent to it, and wherein said C-shaped sections are disposed relative to each other so as to define a split O-shaped configuration.

21. The flipper set forth in claim 1, wherein said hook means is generally U-shaped.

22. The flipper set forth in claim 21, wherein said hook means defines two uprights and a bite portion intermediate said uprights, said uprights being generally parallel to said arms.

23. The flipper set forth in claim 22, wherein said uprights are disposed at right angles to said arms.

24. The flipper set forth in claim 23, wherein said uprights are generally perpendicular to said arms when the leader is released from the fuse.

25. The flipper set forth in claim 1, wherein said connection means is formed from a section of wire which defines two ends which are wrapped about each other so as to define an eyelet, intermediate said ends.

26. The flipper set forth in claim 25, wherein said section of wire is wrapped about itself at least once.

27. The flipper set forth in claim 1, wherein said connection means is coated with an insulating material to electrically insulate said connection means from the leader.

28. The flipper as in claim 27, wherein the insulating material is an epoxy.

29. In a fuse of the type having a generally cylindrical fuse tube a fusible element carried within the tube and a fuse leader, said leader having two ends with one of the ends of the leader connected to the fusible element and with the other of said ends adapted to be connected to a fixed terminal located at a spaced distance from the fuse, the fuse being generally disposed in a first vertical plane with the fixed terminal adapted to be connected to one of the two electrical connections of a power factor capacitor, said two electrical connections defining a second vertical plane which is generally parallel to the first vertical plane, a flipper comprising:

a. two elongated arms disposed adjacent one another, each of said arms having two ends which are oppositely disposed, said ends of each of said arms being generally parallel to one another and each of said arms having an intermediate portion which crosses over the corresponding intermediate portion of the other arm so as to assume a generally X-shaped configuration;

b. spring means, at one end of each of said arms, for biasing the other end of each arm away from the fuse, said spring means comprising a helical coil spring defining two spring ends and a plurality of turns with each turn being immediately adjacent the previous turn so as to form a closely connected helix;

c. clip means, carried by said helical coil spring, for limiting the lateral displacement of said two ends of said spring;

d. hook means, carried by said spring means, for joining said spring means to the terminal to which said fuse leader is connected; and e. insulated connection means, at the other end of said arms, for receiving said fuse leader intermediate the ends of the leader, said arms having a sufficient length such that, when said leader is passed through said connection means and connected to the terminal, said spring means is overcome, said connection means being coated with an insulating material to electrically insulate said connection means from the fuse leader, whereby in the event that the leader is released by the fuse, the free end of the leader is flung away from the fuse and the leader is held at a spaced distance from the terminal.

* * * * *